US007302900B1

(12) United States Patent
Stefano

(10) Patent No.: US 7,302,900 B1
(45) Date of Patent: Dec. 4, 2007

(54) SYSTEM FOR ATTACHING FENDERS AND THE LIKE TO BOATS

(75) Inventor: James M. Stefano, 3321 Scheid Rd., Huron, OH (US) 44839

(73) Assignee: James M. Stefano, Huron, OH (US)

( * ) Notice: Subject to any disclaimer, the term of this patent is extended or adjusted under 35 U.S.C. 154(b) by 0 days.

(21) Appl. No.: 11/236,923

(22) Filed: Sep. 28, 2005

Related U.S. Application Data

(60) Provisional application No. 60/617,354, filed on Oct. 8, 2004.

(51) Int. Cl.
*B63B 21/04* (2006.01)
*B63B 23/64* (2006.01)
*B63B 17/00* (2006.01)

(52) U.S. Cl. ..... 114/218; 114/381; 114/364; 114/343

(58) Field of Classification Search ..... 114/343, 114/218, 219, 364, 381
See application file for complete search history.

(56) References Cited

U.S. PATENT DOCUMENTS 3,398,714 A * 8/1968 Wallin et al. ..... 114/218
4,836,127 A * 6/1989 Wille ..... 114/343
5,435,093 A * 7/1995 Minorics et al. ..... 43/19.2
6,487,984 B1 * 12/2002 Pape et al. ..... 114/218
6,644,230 B1 * 11/2003 Webster ..... 114/218

OTHER PUBLICATIONS

Webster's New World Dictionary, Third College Edition, Simon & Shuster, Inc., 1988, p. 649.*
Brochure "Handi-Cleat" published 2004.

* cited by examiner

*Primary Examiner*—Lars A. Olson
*Assistant Examiner*—Daniel V. Venne
(74) *Attorney, Agent, or Firm*—MacMillan, Sobanski & Todd, LLC

(57) ABSTRACT

Apparatus for attaching fenders and the like to boats includes a post having a lower end configured to be inserted into the well of a fishing rod holder, the post having one or more arms suitable for securing a line connected to a boat fender.

18 Claims, 3 Drawing Sheets

SYSTEM FOR ATTACHING FENDERS AND THE LIKE TO BOATS

RELATED APPLICATIONS

This application claims priority from U.S. Provisional Patent Application Ser. No. 60/617,354, filed Oct. 8, 2004, and entitled SYSTEM FOR ATTACHING FENDERS AND THE LIKE TO BOATS. A related application is U.S. Design patent application Ser. No. 29/238,908, filed Sep. 22, 2005, and entitled ATTACHMENT FOR BOAT FENDERS AND THE LIKE.

TECHNICAL FIELD

This invention relates to apparatus for attaching fenders and other similar objects to boats, and a method of attaching fenders to boats.

BACKGROUND OF THE INVENTION

Boat fenders are designed to be placed on the outboard edges of boat gunnels to provide a soft cushion between the boat and an adjacent dock or other marine structure. This cushioning prevents damage to the boat while the boat is tied up at the dock. It would be advantageous if there could be developed an improved system for attaching fenders to boats. A typical fender includes a body, similar to a bumper, having a surface that is softer than the material of the boat so that the fender or a dock will not scrape, mar or otherwise disfigure the boat surface. Typically, fenders have ropes or lines to enable the fender to be hung or suspended on the side of the boat while the boat is docked. Attachments for securing boat fenders are usually made to be readily removable because after the boat leaves its mooring at a dock, it is desirable to remove the fender and stow it away.

SUMMARY OF THE INVENTION

According to this invention there is provided apparatus for attaching fenders and the like to boats. The apparatus includes a post having a lower end configured to be inserted into the well of a fishing rod holder. The post has one or more arms suitable for securing a line connected to a boat fender.

According to this invention there is also provided apparatus for attaching fenders and the like to boats, with the apparatus having a post with a lower end configured to be inserted into the well of a fishing rod holder. The post has an attachment means at an upper end suitable for securing a line connected to a boat fender, and the post is readily removable and reinsertable into the well of the fishing rod holder.

According to this invention there is also provided apparatus for attaching fenders to boats, with the apparatus including a post having a lower end configured to be inserted into the well of a fishing rod holder. The post has two opposed arms forming a cross-shaped configuration at an upper end suitable for securing a line connected to a boat fender, and the post is readily removable and reinsertable into the well of the fishing rod holder. The post has a bend, thereby dividing the post into the upper end and the lower end, with the upper end being non-collinear with the lower end.

According to this invention there is also provided a method for attaching fenders and the like to boats. The method includes inserting the lower end of a post into the well of a fishing rod holder located on the boat. The post has an attachment means, such as one or more arms, suitable for securing a line connected to a boat fender. The method further includes attaching the fender to the boat by securing a fender line to the attachment means.

DETAILED DESCRIPTION OF THE INVENTION

Figure 1:
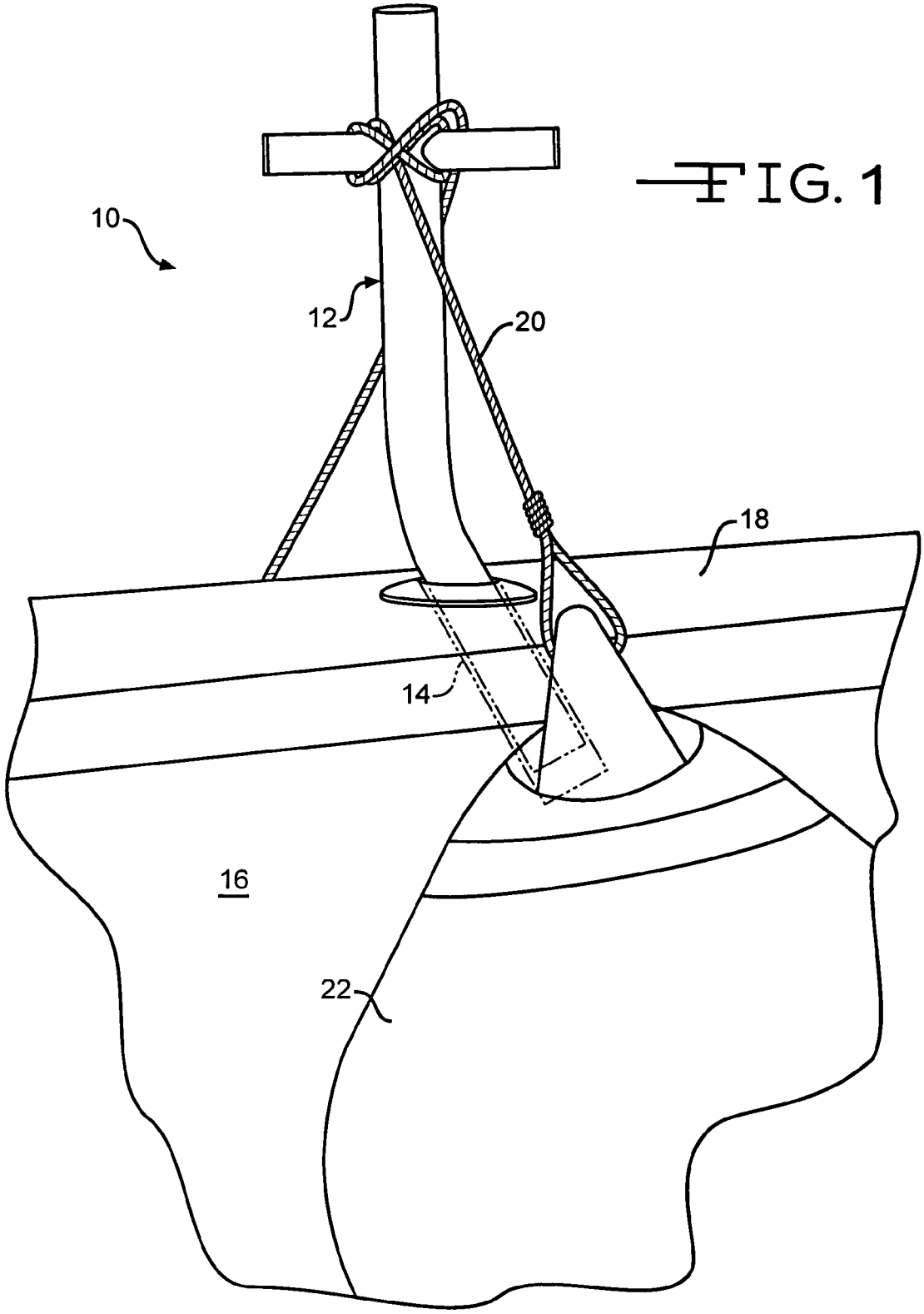
FIG. 1 is a perspective view of a portion of a boat equipped with an apparatus for attaching fenders to boats.

The invention includes apparatus and a method for attaching fenders to boats. The apparatus, generally indicated at 10 in FIG. 1, includes a post 12 configured to be inserted into the well of a fishing rod holder 14 mounted on a boat 16. Fishing rod holders 14 are common on boats, particularly on larger pleasure craft such as yachts or sport fishing boats. The fishing rod holders 14 are often comprised of a substantially cylindrical cavity or well, usually positioned in a gunnel 18 or other substantially horizontal surface of the boat. A line 20 can be secured to the post 12 to attach a fender 22 to the boat 16. The post 12 is readily removable and reinsertable into the well of the fishing rod holder 14. This allows the post 12 to be removed and easily stored when not in use, and then readily returned to the well of the fishing rod holder 14 when needed.

Figure 2:
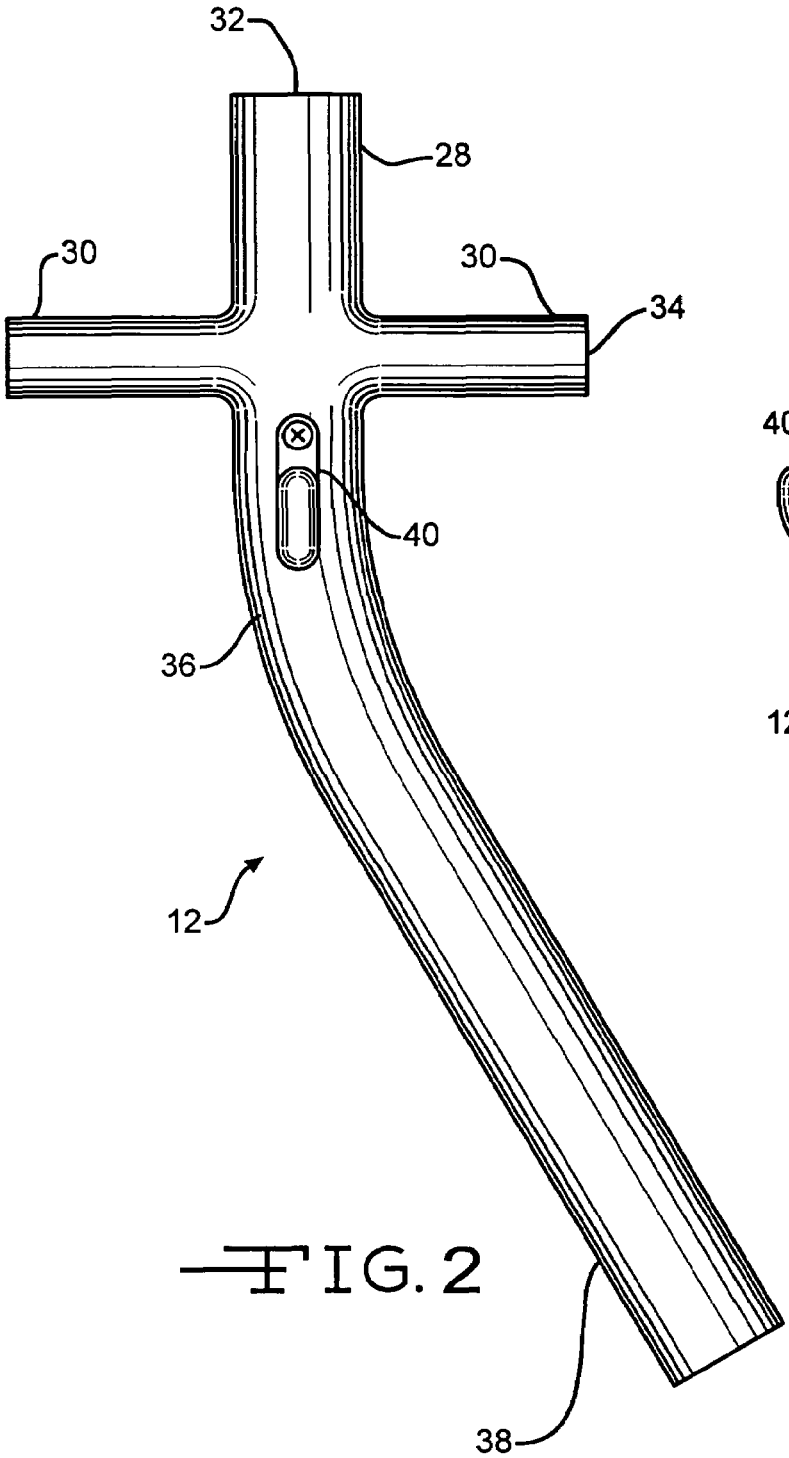
FIG. 2 is a side view in elevation of the apparatus for attaching fenders to boats.
Figure 3:
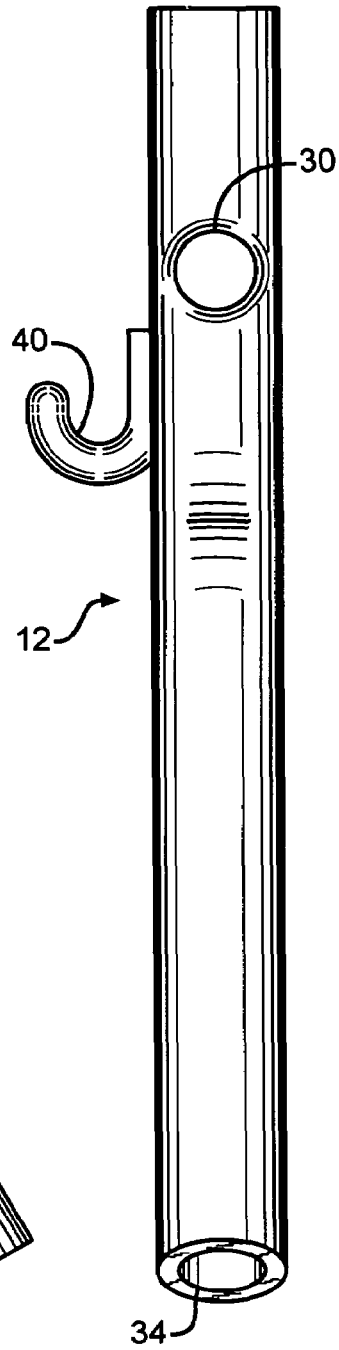
FIG. 3 is an end view in elevation of the apparatus of FIG. 2.

As shown in FIGS. 2-3, the post 12 has an attachment means at an upper end 28 suitable for securing a line connected to a boat fender. In one embodiment of the invention, the attachment means is comprised of one or more arms 30 that extend horizontally from the post 12, i.e., substantially perpendicular to the post. In a specific embodiment of the invention, the post 12 has two opposed arms 30 forming the post into a cross-shaped configuration. Three or more arms 30 can also be used. Further, the arms 30 can be mounted to the post 12 at the top 32 of the post 12 to form the shape of a capital T. The arms 30 can be attached to the post 12 by any suitable means, such as by welding or bolting. The post 12 and arms 30 can be made of aluminum or stainless steel tubing. Other materials, such as wood and composite materials, can also be used. The arms 30 are secured to the post 12 at an upper end 28 of the post 12 so that the arms 30 are spaced apart from the well of the fishing rod holder 14 when the post 12 is installed on the boat 16. This makes it easier to tie the fender line 20 to the post 12. The post 12 can be made of tubular members, and optionally can be provided with fittings or stoppers, not shown, to close the hollow ends 34.

The post 12 is optionally provided with a bend, indicated at 36, thereby dividing the post 12 into the upper end 28 and a lower end 38, with the upper end 28 being non-collinear with the lower end 38. Typical fishing rod holder wells on boat gunnels are oriented at an angle to the vertical, and the bend 36 in the post 12 enables the upper end 28 to be oriented vertically. The bend can be at any suitable angle, such as at an angle within the range of from about 10 degrees to about 35 degrees.

It is to be understood that the post 12 can be used to tie lines other than fender lines 20, such as for example lines for a chum bag or a dragging sea anchor, both not shown.

The post 12 of the fender attaching apparatus 10 can be provided with an optional hook 40 for hanging lines, such as, for example power lines or water lines, not shown, when the boat 16 is docked. The hook 40 can be attached to the post 12 in any suitable manner, such as by welding or bolting. Other types and shapes of hooks or other fixtures can be attached to the post 12.

Figure 4:
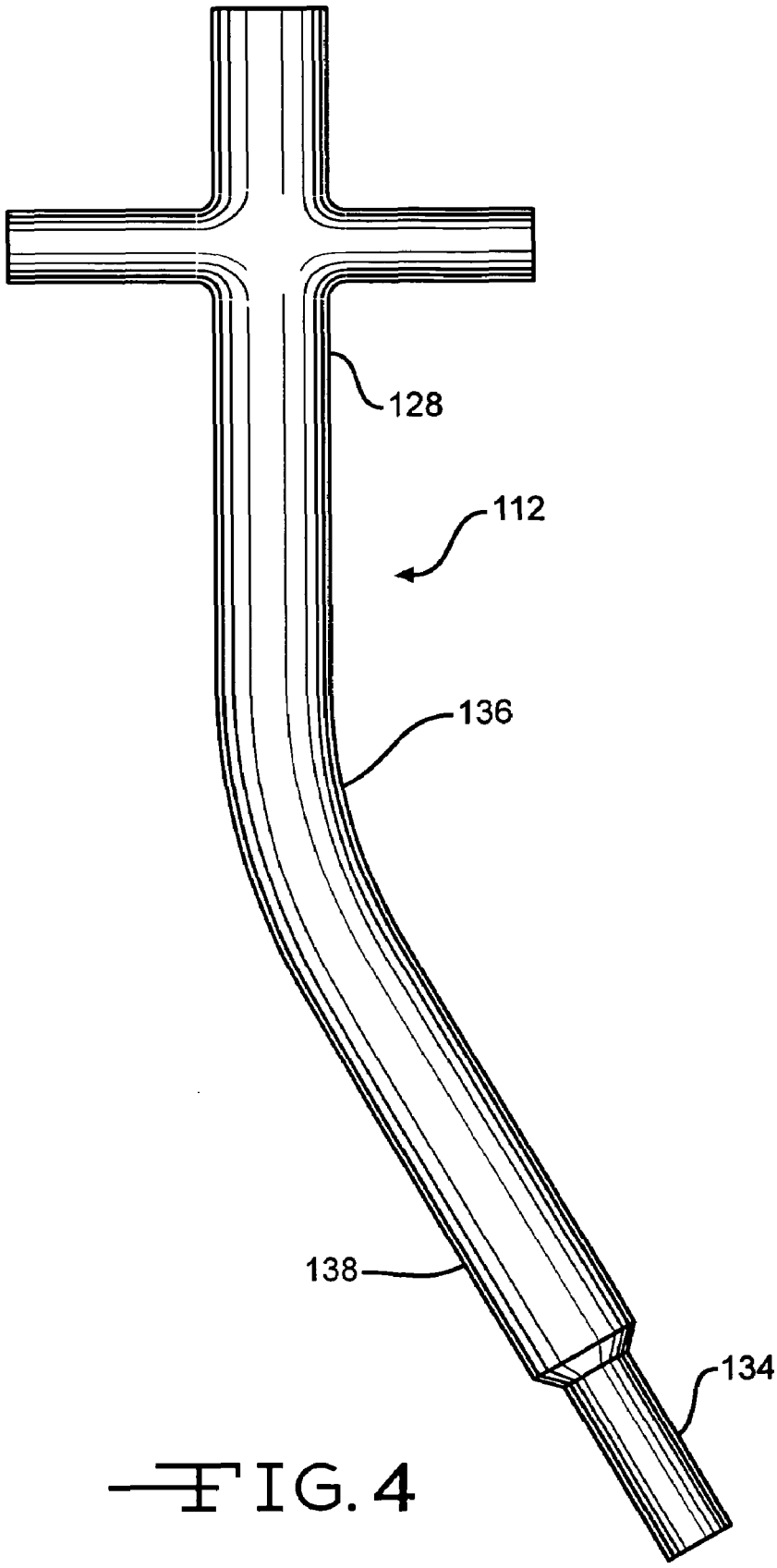
FIG. 4 is a side view in elevation of apparatus similar to that shown in FIG. 2, but having a portion of the lower end configured with a reduced diameter.

As shown in FIG. 4, the post 112 has an upper end 128 and a lower end 138, with a bend 136. The bend 136 is provided along the post 112 at a position dividing the upper end 128 and lower end into substantially equal lengths. It is to be understood that the upper end 128 and the lower end 138 can be of any suitable lengths. The lower end 138 is provided with an optional narrow diameter region 134 to provide a good fit with different shaped wells of fishing rod holders.

The attachment means can be of a configuration other than that of the two arms 30. For example, a conventional cleat, welded loops, orifices, or other fixtures can be added to the post 12 to enable the fender line 20 to be added to the post 12.

According to the method of the invention, the lower end 38 of the post 12 is inserted into the well of a fishing rod holder 14 located on the boat 16. The method includes attaching the fender to the boat by securing a fender line 20 to the attachment means. When the boat 16 is docked, the post is put in place to protect the boat. Since the post is readily removable and replaceable, after the boat 16 leaves the dock, the boat fender 22 and the post 12 can be removed and stored.

The principle and mode of operation of this invention have been described in its preferred embodiments. However, it should be noted that this invention may be practiced otherwise than as specifically illustrated and described without departing from its scope.

What is claimed is:

1. An attachment apparatus for boats that have a well for holding a fishing rod, the apparatus comprising a post having a bend, thereby dividing the post into an upper end and a lower end, with the upper end being non-collinear with the lower end, and with the upper end and the lower end defining a plane, with the lower end being configured to be inserted into the fishing rod well, the post having two opposed arms, the arms being rigidly attached to the post, the arms being suitable for securing a line connected to a boat fender, and the arms lying in the plane.

2. The apparatus of claim 1 in which the arms form a cross-shaped configuration.

3. The apparatus of claim 1 in which the bend has an angle within a range of from about 10 degrees to about 35 degrees.

4. The apparatus of claim 1 in which the arms are secured to the post at an upper end of the post so that the arms are spaced apart from the well of the fishing rod holder when the post is installed on a boat.

5. The apparatus of claim 1 including a hook suitable for hanging lines.

6. The apparatus of claim 1 in which the lower end of the post is provided with a narrow diameter region.

7. An attachment apparatus for boats that have a well for holding a fishing rod, the fishing rod well having a circular internal cross-sectional cavity and being oriented at a rearward angle to a vertical line, and in a plane substantially parallel to a side hull of the boat, the apparatus comprising a single post having a lower end and an upper end, the lower end having a circular cross-sectional shape compatible with the internal shape of the fishing rod holder, and being configured to be inserted into the fishing rod well, the post having one or more arms attached to the upper end and configured for securing a line connected to a boat fender.

8. The apparatus of claim 7 in which the one or more arms comprises two opposed arms forming a cross-shaped configuration.

9. The apparatus of claim 7 in which the post has a bend, thereby dividing the post into the upper end and the lower end, with the upper end being non-collinear with the lower end.

10. The apparatus of claim 9 in which the bend has an angle within a range of from about 10 degrees to about 35 degrees.

11. The apparatus of claim 7 in which the one or more arms are secured to the post at the upper end of the post so that the arms are spaced apart from the well when the post is installed on a boat.

12. The apparatus of claim 7 including a hook suitable for hanging lines.

13. An attachment apparatus for boats that have a well for holding a fishing rod, the apparatus comprising a post having a bend, the bend dividing the post into an upper end and a lower end, with the upper end being non-collinear with the lower end, and with the upper end and the lower end defining a plane, and the lower end being configured to be inserted into the fishing rod well, the post having one or more arms configured for securing a line connected to a boat fender, with the one or more arms lying in the plane.

14. The apparatus of claim 13 in which the one or more arms comprise two opposed arms forming a cross-shaped configuration.

15. The apparatus of claim 13 in which the bend has an angle within a range of from about 10 degrees to about 35 degrees.

16. The apparatus of claim 13 in which the one or more arms are secured to the post at an upper end of the post so that the arms are spaced apart from the well of the fishing rod holder when the post is installed on a boat.

17. The apparatus of claim 13 including a hook suitable for hanging lines.

18. The apparatus of claim 13 in which the lower end of the post is provided with a narrow diameter region.

* * * * *